US011349241B2

(12) United States Patent
Orris

(10) Patent No.: US 11,349,241 B2
(45) Date of Patent: May 31, 2022

(54) POWER SOCKET FOR ELECTRICAL CONNECTOR SYSTEM

(71) Applicant: TE Connectivity Services GmbH, Schaffhausen (CH)

(72) Inventor: David Patrick Orris, Middletown, PA (US)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

(21) Appl. No.: 17/026,439

(22) Filed: Sep. 21, 2020

(65) Prior Publication Data

US 2022/0094095 A1 Mar. 24, 2022

(51) Int. Cl.

| | |
|---|---|
| ***H01R 13/11*** | (2006.01) |
| ***H01R 4/02*** | (2006.01) |
| ***H01R 4/20*** | (2006.01) |
| ***H01R 13/187*** | (2006.01) |

(52) U.S. Cl.

CPC ..... *H01R 13/111* (2013.01); *H01R 4/029* (2013.01); *H01R 4/20* (2013.01); *H01R 13/187* (2013.01)

(58) Field of Classification Search

CPC ..... H01R 13/187

See application file for complete search history.

(56) References Cited

U.S. PATENT DOCUMENTS

| | | | | |
|---|---|---|---|---|
| 3,914,009 | A | 10/1975 | Chia et al. | |
| 3,980,387 | A * | 9/1976 | Neidecker | H01R 13/187 439/750 |
| 4,662,706 | A * | 5/1987 | Foley | H01R 13/187 439/843 |
| 4,906,212 | A | 3/1990 | Mixon, Jr. | |
| 5,358,433 | A | 10/1994 | Dechanteloup et al. | |
| 5,376,012 | A | 12/1994 | Clark | |
| 6,190,215 | B1 | 2/2001 | Pendleton et al. | |
| 6,520,998 | B1 * | 2/2003 | Scholler | H01R 13/187 439/843 |
| 6,656,002 | B2 | 12/2003 | Zhao et al. | |
| 10,396,472 | B2 * | 8/2019 | Baldauf | H01R 4/625 |
| 2013/0247374 | A1 * | 9/2013 | Li | H01R 4/20 29/860 |
| 2020/0067207 | A1 * | 2/2020 | Saito | H01R 43/0207 |
| 2021/0098919 | A1 * | 4/2021 | Nakagawa | H01R 4/56 |

* cited by examiner

*Primary Examiner* — Ross N Gushi

(57) ABSTRACT

A power socket includes a power socket body extending between a first end and a second end and having a tube being tubular shaped along at least a portion of the power socket body. The power socket includes a power pin termination at the first end and a cable termination at the second end. The power pin termination includes a socket configured to receive a mating end of a power pin and a spring band contact received in the socket having a plurality of mating interfaces. A first edge of the power socket body is rolled inward to form a retaining lip to retain the spring band contact in the socket. The cable termination includes a deformation terminated to an end of a cable conductor of a cable to electrically connect the power socket to the cable. The deformation transforms the tube from a tubular to a deformed shape.

20 Claims, 3 Drawing Sheets

POWER SOCKET FOR ELECTRICAL CONNECTOR SYSTEM

BACKGROUND OF THE INVENTION

The subject matter herein relates generally to power sockets for electrical connector systems.

Electrical connector systems use power sockets to provide power to various components. For example, the power socket may be provided at an end of a cable and a pin or other type of terminal may be coupled to the power socket. Conventional power sockets are screw machined parts having a hollow bore forming the socket that receives the cable and an opening that receives the pin. An undercut is machined into the opening to hold a contact configured to be mated with the pin. The screw machined parts are expensive to manufacture. The undercut machining process adds additional expense to manufacturing the power socket.

A need remains for a low cost and reliable power socket.

BRIEF DESCRIPTION OF THE INVENTION

In one embodiment, a power socket is provided including a power socket body extending between a first end and a second end and having a tube being tubular shaped along at least a portion of the power socket body. The power socket includes a power pin termination at the first end and a cable termination at the second end. The power pin termination includes a socket configured to receive a mating end of a power pin. The power pin termination includes a spring band contact received in the socket having a plurality of mating interfaces pinching inward for mating with the power pin. A first edge of the power socket body is rolled inward to form a retaining lip to retain the spring band contact in the socket. The cable termination includes a deformation configured to be terminated to an end of a cable conductor of a cable to electrically connect the power socket to the cable. The deformation transforms the tube from the tubular shape to a deformed shape.

In another embodiment, a power socket is provided including a power socket body extending between a first end and a second end and having a tube being tubular shaped along at least a portion of the power socket body. The power socket includes a power pin termination at the first end and a cable termination at the second end. The power pin termination includes a socket configured to receive a mating end of a power pin. The power pin termination includes a spring band contact received in the socket having a plurality of mating interfaces pinching inward for mating with the power pin. A first edge of the power socket body is rolled inward to form a retaining lip to retain the spring band contact in the socket. The cable termination includes a deformation configured to be terminated to an end of a cable conductor of a cable to electrically connect the power socket to the cable. The deformation is generally flat forming a pad configured to interface with the cable conductor at an outer surface of the pad.

In a further embodiment, a power socket is provided including a power socket body extending between a first end and a second end and having a tube being tubular shaped along at least a portion of the power socket body. The power socket includes a power pin termination at the first end and a cable termination at the second end. The power pin termination includes a socket configured to receive a mating end of a power pin. The power pin termination includes a spring band contact received in the socket having a plurality of mating interfaces pinching inward for mating with the power pin. A first edge of the power socket body is rolled inward to form a retaining lip to retain the spring band contact in the socket. The cable termination includes a deformation configured to be terminated to an end of a cable conductor of a cable to electrically connect the power socket to the cable. The deformation is a crimp barrel configured to interface with the cable conductor at an inner surface of the crimp barrel.

DETAILED DESCRIPTION OF THE INVENTION

Figure 1:
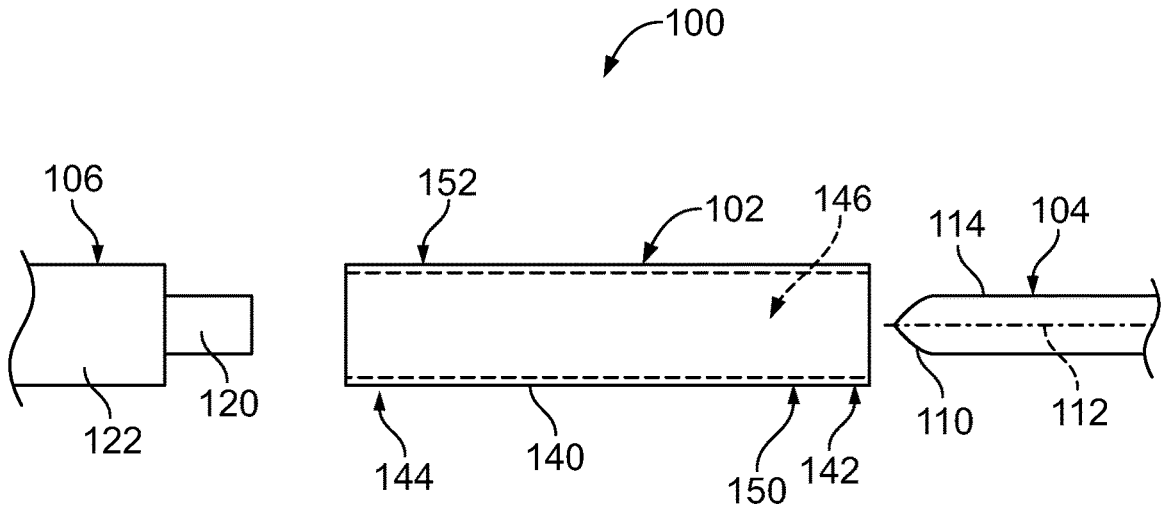
FIG. 1 illustrates an electrical connector system including a power socket in accordance with an exemplary embodiment.

FIG. 1 is a schematic illustration of an electrical connector system 100 including a power socket 102 in accordance with an exemplary embodiment. The power socket 102 is used to electrically connect a first power component 104 and the second power component 106. In an exemplary embodiment, the power socket 102 is permanently coupled to the second power component 106 and coupled to the first power component 104 at a separable mating interface. In the illustrated embodiment, the first power component 104 is a power pin that may be referred to hereinafter as a power pin 104. In the illustrated embodiment, the second power component 106 is a cable and may be referred to hereinafter as a cable 106.

The power pin 104 includes a mating end 110 configured to be plugged into the power socket 102. The mating end 110 may be tapered to guide mating with the power socket 102. The power pin 104 is mated along a mating axis 112. The power pin 104 includes an outer surface 114 configured to engage and electrically connect with the power socket 102.

The cable 106 includes a center conductor 120 and a cable jacket 122 surrounding the center conductor 120. The center conductor 120 may be a solid core conductor in various embodiments. The center conductor 120 may be a stranded wire in other various embodiments. The center conductor may be flattened rather than being round in other various embodiments. A portion of the cable jacket 122 may be removed to expose the center conductor 120. In alternative embodiments, the cable 106 may be a coaxial cable having an insulator surrounding the center conductor 120 and a cable shield surrounding the insulator. The cable jacket 122 may surround the cable shield.

The power socket 102 electrically connects the cable 106 with the power pin 104. The power socket 102 is manufactured from a process other than machining. In an exemplary embodiment, the power socket 102 is a forged power socket. For example, the power socket 102 may be formed using compressive forces. The power socket may be stamped and formed in various embodiments. The power socket 102 is manufactured in a cost effective manner without the use of expensive machining.

In an exemplary embodiment, the power socket 102 includes a power socket body 140 extending between a first end 142 and a second end 144. The power socket body 140 has a hollow tube 146 being tubular shaped along at least a portion of the power socket body 140. The tube 146 may be stamped and formed. For example, the tube 146 may be formed from a flat sheet of metal is rolled into a tubular shape. The tube 146 may be formed by other processes. For example, the tube 146 may be extruded. The tube 146 is made hollow to receive the power pin 104 and/or the cable 106. In an exemplary embodiment, the power socket 102 includes a power pin termination 150 at the first end 142 and a cable termination 152 at the second end 144. The power pin termination 150 is configured to be electrically connected to the power pin 104. The cable termination 152 is configured to be electrically connected to the cable 106. In various embodiments, the power pin termination 150 is oriented relative to the cable termination 152 such that the power pin 104 and the cable 106 are oriented parallel to each other. In other various embodiments, the power pin termination 150 is oriented relative to the cable termination 152 such that the power pin 104 and the cable 106 are oriented perpendicular to each other. For example, the power socket body 140 may include a 90° bend to orient the power pin termination 150 and the cable termination 152 perpendicular to each other.

Figure 2:
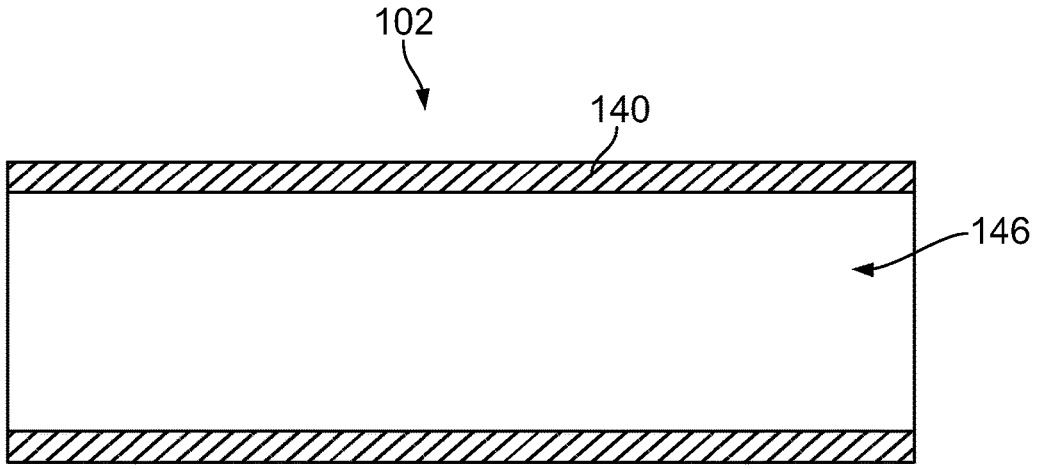
FIG. 2 is a cross sectional view of the power socket during an initial forming stage of manufacture.

FIG. 2 is a cross sectional view of the power socket 102 during an initial forming stage of manufacture. During manufacture, the power socket body 140 is formed in the tubular shape. For example, during the initial forming stage manufacture, the power socket body 140 may have a uniform diameter along a length of the power socket body 140. The power socket body 140 may have a uniform wall thickness around the exterior of the hollow tube 146. In an exemplary embodiment, during a later stage manufacture, at least a portion of the power socket body 140 is deformed to transform the tube 146 from the tubular shape (shown in FIG. 2) to a deformed shape. The deformation is used to form features for termination to the power pin 104 (shown in FIG. 1) and the cable 106 (shown in FIG. 1).

Figure 3:
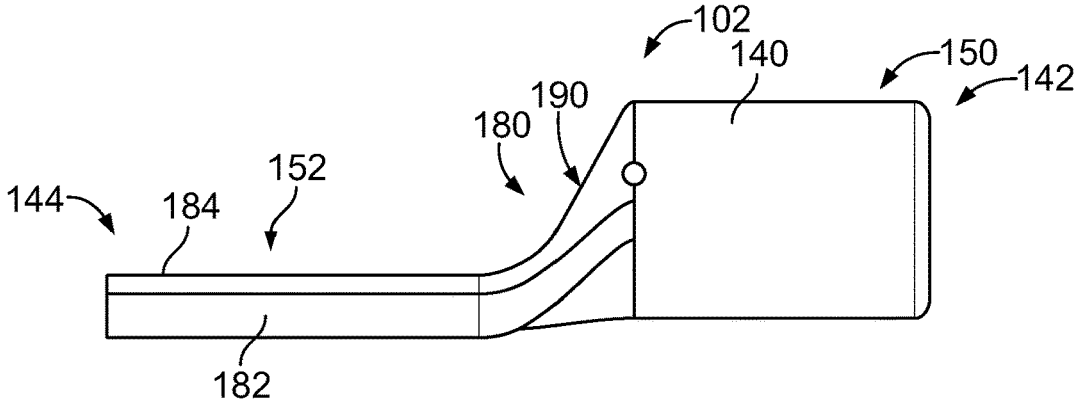
FIG. 3 is a side view of the power socket in accordance with an exemplary embodiment.
Figure 4:
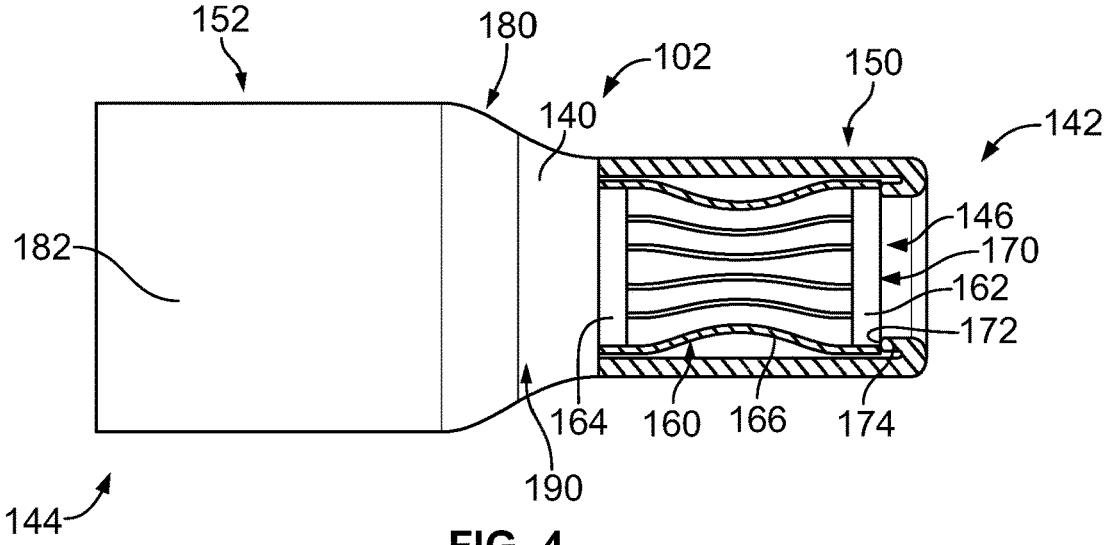
FIG. 4 is a top view of the power socket in accordance with an exemplary embodiment.

FIG. 3 is a side view of the power socket 102 in accordance with an exemplary embodiment. FIG. 4 is a top view of the power socket 102 in accordance with an exemplary embodiment. FIG. 4 illustrates a portion of the power socket 102 in sectional view to illustrate a spring band contact 160 in accordance with an exemplary embodiment. The spring band contact 160 is provided at the power pin termination 150 to mate with the mating end 110 of the power pin 104 (shown in FIG. 1).

The spring band contact 160 includes a protruding portion that defines the mating interface for mating with the power pin 104. The protruding portion is configured to be deflected or compressible against the power pin 104 to ensure a positive electrical connection with the power pin 104. In an exemplary embodiment, the spring band contact 160 includes a first ring 162 and a second ring 164 with spring beams 166 extending therebetween. The spring beams 166 have separable mating interfaces for mating with the power pin 104. The spring beams 166 are deflectable relative to each other and relative to the rings 162, 164. In an exemplary embodiment, the spring band contact 160 has an hourglass shape that is narrower in a middle of the spring band contact 160 and wider at the ends of the spring band contact 160. For example, the spring beams 166 are bent inward into an interior of the spring band contact 160 such that the spring band contact 160 has a smaller diameter at a central region of the spring band contact 160 and larger diameters at the opposite ends of the spring band contact 160. The first and second rings 162, 164 are provided at the ends of the spring band contact 160. In an exemplary embodiment, the first and second rings 162, 164 have similar diameters. The spring beams 166 are curved inward relative to the rings 162, 164 such that the spring beams 166 have a smaller diameter than the rings 162, 164 at the mating interfaces 160. The diameters of the rings 162, 164 are larger than a diameter of the power pin 104. The diameter of the spring band contact 160 along the spring beams 166 is narrower than the diameter of the power pin 104 such that the spring beams 166 interfere with the power pin 104 when the power pin 104 is mated with the spring band contact 160. The spring beams 166 pinch inward to interface with the power pin 104 and are configured to be deflected outward when the power pin 104 is mated with the spring band contact 160. The spring band contact 160 may have other shapes in alternative embodiments.

The power pin termination 150 is provided at the first end 142 of the power socket body 140. The power pin termination 150 includes a socket 170 configured to receive the mating end 110 of the power pin 104. The spring band contact 160 is received in the socket 170. In an exemplary embodiment, the socket 170 is sized slightly larger than the spring band contact 160 to receive the spring band contact 160 therein. For example, the socket 170 may be slightly longer than the spring band contact 160 to receive the spring band contact 160 therein.

In an exemplary embodiment, after the spring band contact 160 is received in the socket 170, a first edge 172 of the power socket body 140 is rolled inward to form a retaining lip 174 to retain the spring band contact 160 in the socket 170. When the first end 172 of the power socket body 140 is rolled inward, a diameter of the power socket body 140 is reduced. For example, the power socket body 140 at the retaining lip 174 may have a diameter equal to or less than a diameter of the spring band contact 160 to retain the spring band contact 160 in the socket 170. As such, the power socket 102 uses the material of the power socket body 140 itself to retain the spring band contact 160 in the socket 170. Additional components are not needed to retain the spring band contact 160 in the socket 170. Other types of retaining features may be used in alternative embodiments to retain the spring band contact 160 in the socket 170.

The cable termination 152 is provided at the second end 144 of the power socket body 140. The cable 106 is configured to be terminated to the power socket 102 at the cable termination 152. In an exemplary embodiment, the cable termination 152 includes a deformation 180 configured to be terminated to an end of the center conductor 120 of the cable 106 to electrically connect the power socket 102 to the cable 106. The deformation 180 is formed by compressing the tube 146 into a different, non-tubular shape. The deformation 180 transforms the tube 146 from the tubular shape into a deformed shape. In the illustrated embodiment, the cable termination 152 is deformed into a generally flat structure. The deformation 180 forms a pad 182. The pad 182 includes an exterior 184. The center conductor 120 is coupled to the exterior 184. In an exemplary embodiment, the pad 182 may be a weld pad and the center conductor 120 is configured to be welded to the weld pad. Alternatively, the center conductor 120 may be mechanically and electrically connected to the pad 182 using a fastener. For example, the pad 182 may include an opening (not shown) configured to receive a fastener, such as a screw. The fastener may be tightened to compress and retain the center conductor 120 between the screw head and the pad 182.

In an exemplary embodiment, the power socket 102 includes a socket pinch 190. The socket pinch 190 is formed by the deformation 180. For example, when the second end 144 of the tube 146 is flattened to form the pad 182, the socket pinch 190 is formed between the pad 182 and the tube 146 at the first end 142. The socket pinch 190 reduces at least one dimension of the power socket body 140 compared to the portion of the power socket body 140 forming the socket 170. For example, the socket pinch 190 may be wider and shorter than the tube 146. The socket pinch 190 defines a stop for the spring band contact 160. The spring band contact 160 is captured between the socket pinch 190 and the retaining lip 174 to hold an axial position of the spring band contact 160 in the socket 170. During assembly, the spring band contact 160 is loaded into the socket 170 and bottoms out against the socket pinch 190. Once positioned, the first edge 172 of the tube 146 may be rolled inward to form the retaining lip 174 to capture the spring band contact 160 in the socket 170.

Figure 5:
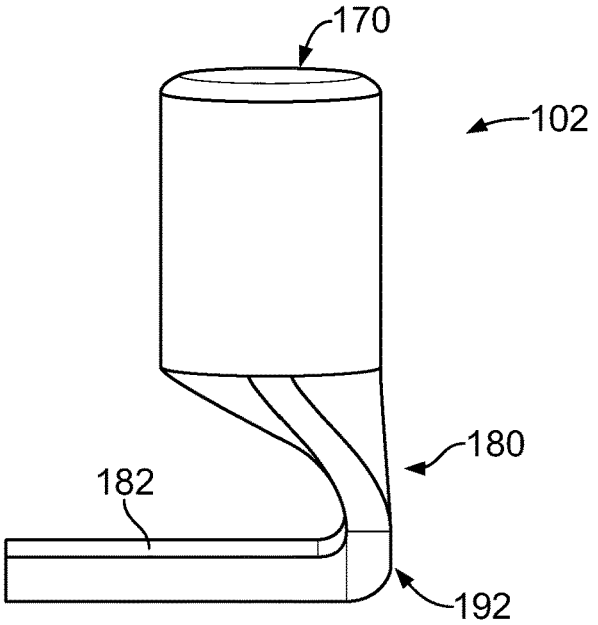
FIG. 5 is a side view of the power socket in accordance with an exemplary embodiment.

FIG. 5 is a side view of the power socket 102 in accordance with an exemplary embodiment. In the illustrated embodiment, the cable termination 152 includes a right angle bend 192 at the deformation 180. In the illustrated embodiment, the bend 192 is provided at the intersection between the pad 182 and the socket pinch 190. The bend 192 may be provided at other locations in alternative embodiments. The right-angle power socket 102 allows the socket 170 to be oriented perpendicular to the pad 182. As such, the power socket 102 receives the power pin 104 (shown in FIG. 1) in a direction perpendicular to the cable 106.

Figure 6:
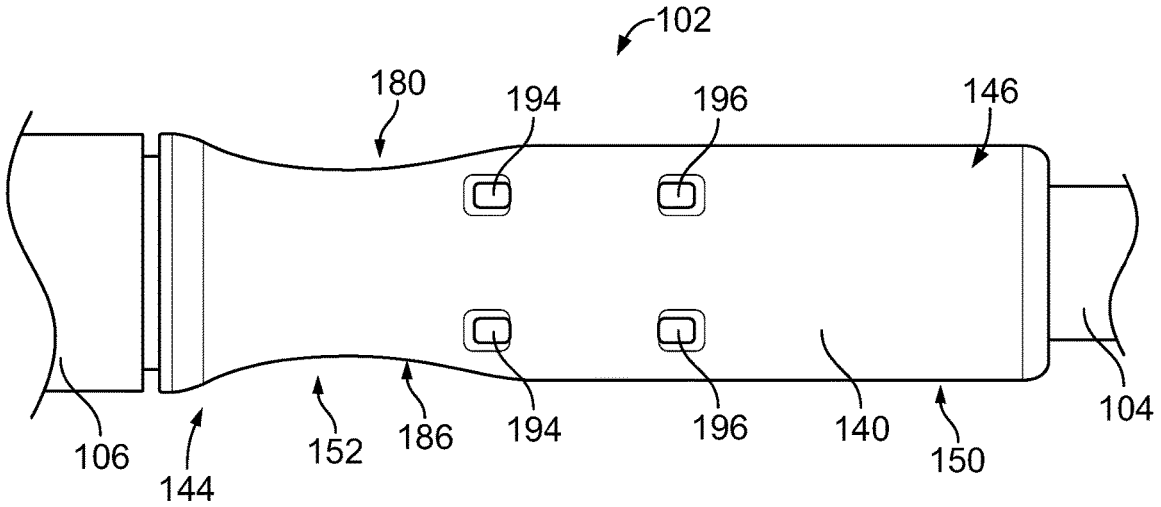
FIG. 6 is a side view of the power socket in accordance with an exemplary embodiment.
Figure 7:
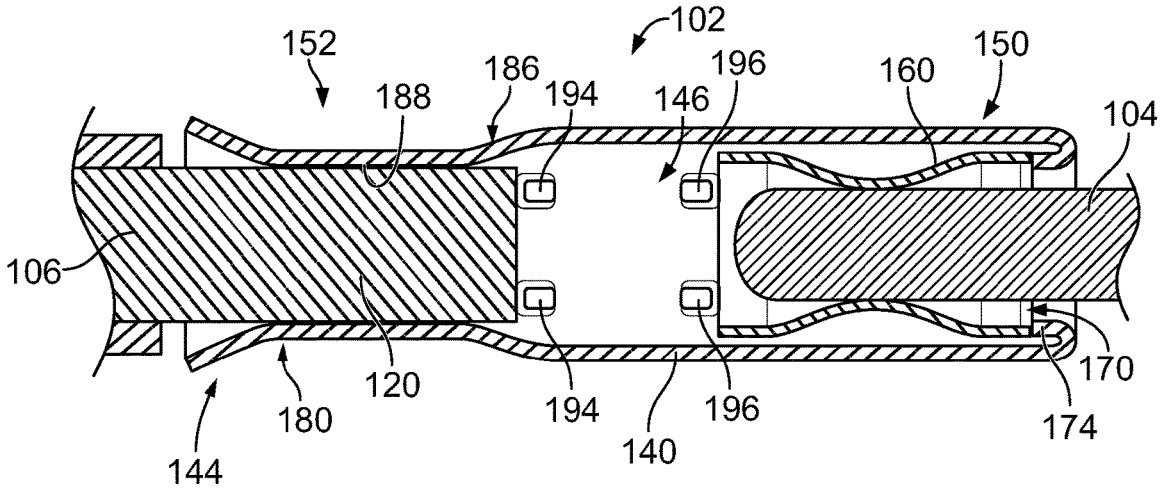
FIG. 7 is a cross-sectional view of the power socket in accordance with an exemplary embodiment.

FIG. 6 is a side view of the power socket 102 in accordance with an exemplary embodiment. FIG. 7 is a cross-sectional view of the power socket 102 in accordance with an exemplary embodiment. In the illustrated embodiment, the power pin termination 150 is similar to the power pin termination illustrated in FIGS. 3 and 4. In the illustrated embodiment, the cable termination 152 receives the cable 106 located interior of the power socket 102 rather than an exterior of the power socket 102 as with the embodiments illustrated in FIGS. 3 and 4.

In an exemplary embodiment, the deformation 180 includes a crimp barrel 186. The crimp barrel 186 has an interior 188. The cable 106 is received in the crimp barrel 186 and the crimp barrel 186 is deformed, such as by a compression using a crimping tool. The interior 188 of the crimp barrel 186 is compressed against the center conductor 120 of the cable 106 to make a mechanical and electrical connection between the power socket 102 and the cable 106. Optionally, the second end 144 of the power socket body 140 is open and flared outward to guide the cable 106 into the crimp barrel 186.

In an exemplary embodiment, the power socket body 140 includes a cable stop tab 194 extending into the tube 146 defining the crimp barrel 186. The cable stop tab 194 defines a cable stop for the cable 106. The cable 106 is loaded into the crimp barrel 186 until the end of the cable 106 bottoms out against the cable stop tab 194. Optionally, multiple cable stop tabs 194 may be provided around the circumference of the crimp barrel 186. The cable stop tabs 194 may be stamped from the tube 146 and bent inward into the interior of the tube 146 to form a stop surface for the cable 106.

In an exemplary embodiment, the power socket body 140 includes a spring band contact stop tab 196 extending into the tube 146 defining the socket 170. The spring band contact stop tab 196 defines a stop surface for the spring band contact 160. The spring band contact 160 is loaded into the socket 170 until the end of the spring band contact 160 bottoms out against the spring band contact stop tab 196. Optionally, multiple spring band contact stop tabs 196 may be provided around the circumference of the tube 146. The spring band contact stop tabs 196 may be stamped from the tube 146 and bent inward into the interior of the tube 146 to form the stop surface for the spring band contact 160. The spring band contact 160 is captured between the spring band contact stop tabs 196 and the retaining lip 174 to hold the axial position of the spring band contact 160 in the socket 170.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A power socket comprising:

a power socket body extending between a first end and a second end, the power socket body being a stamped and formed body having a tubular portion being tubular shaped along at least a portion of the power socket body, the power socket body including a wall stamped from a metal sheet and having a uniform thickness;

a power pin termination at the first end, the power pin termination including a socket surrounded by the wall and configured to receive a mating end of a power pin, the power pin termination including a spring band contact received in the socket along the tubular portion, the spring band contact having a plurality of mating interfaces pinching inward for mating with the power pin, a first edge of the wall of the power socket body being rolled inward to form a retaining lip to retain the spring band contact in the socket; and a cable termination at the second end, the cable termination defined by a non-tubular deformed portion of the wall of the power socket body configured to be terminated to an end of a cable conductor of a cable to electrically connect the power socket to the cable, the deformed portion of the wall of the power socket body being compressed by compressive forces to transition the power socket body from the tubular shape to a non-tubular deformed shape.

2. The power socket of claim 1, wherein the cable termination includes an exterior surface, the cable conductor being terminated to the exterior surface.

3. The power socket of claim 1, wherein the cable termination includes an interior surface defining a socket configured to receive the cable conductor therein such that the interior surface engages and electrically connects to the cable conductor.

4. The power socket of claim 1, wherein the deformed portion of the cable termination is generally flat.

5. The power socket of claim 1, wherein the deformed portion of the cable termination includes a weld pad.

6. The power socket of claim 1, wherein the deformed portion of the cable termination includes a crimp portion configured to be crimped to the end of the cable conductor.

7. The power socket of claim 1, wherein the deformed portion of the cable termination includes a socket pinch, the socket pinch reducing at least one dimension of the power socket body compared to the socket.

8. The power socket of claim 7, wherein the socket pinch defines a stop for the spring band contact.

9. The power socket of claim 7, wherein the spring band contact is captured between the socket pinch and the retaining lip to hold an axial position of the spring band contact in the socket.

10. The power socket of claim 1, wherein the deformed portion includes a 90° bend.

11. The power socket of claim 1, wherein the deformed portion is oriented perpendicular to the socket such that the pin contact is oriented perpendicular to the cable.

12. The power socket of claim 1, wherein the power socket body includes a cable stop tab extending into the power socket body defining a cable stop for the cable and wherein the power socket body includes a spring band contact stop tab extending into the power socket body defining a stop surface for the spring band contact, the spring band contact is captured between the spring band contact stop tab and the retaining lip to hold an axial position of the spring band contact in the socket.

13. A power socket comprising:

a power socket body extending between a first end and a second end, the power socket body being a stamped and formed body having a tubular portion being tubular shaped along at least a portion of the power socket body, the power socket body including a wall stamped from a metal sheet and having a uniform thickness;

a power pin termination at the first end, the power pin termination including a socket configured to receive a mating end of a power pin, the power pin termination including a spring band contact received in the socket along the tubular portion, the spring band contact having a plurality of mating interfaces pinching inward for mating with the power pin, a first edge of the power socket body being rolled inward to form a retaining lip to retain the spring band contact in the socket; and a cable termination at the second end, the cable termination defined by a non-tubular deformed portion of the power socket body configured to be terminated to an end of a cable conductor of a cable to electrically connect the power socket to the cable, the deformed portion being generally flat forming a pad configured to interface with the cable conductor at an outer surface of the pad.

14. The power socket of claim 13, wherein the pad is a weld pad.

15. The power socket of claim 13, wherein the deformed portion of the cable termination includes a socket pinch, the socket pinch reducing at least one dimension of the power socket body compared to the socket to form a stop for the spring band contact.

16. The power socket of claim 15, wherein the spring band contact is captured between the socket pinch and the retaining lip to hold an axial position of the spring band contact in the socket.

17. The power socket of claim 13, wherein the deformed portion is oriented perpendicular to the socket such that the pin contact is oriented perpendicular to the cable.

18. A power socket comprising:

a power socket body extending between a first end and a second end, the power socket body being a stamped and formed body having a tubular portion being tubular shaped along at least a portion of the power socket body, the power socket body including a wall stamped from a metal sheet and having a uniform thickness;

a power pin termination at the first end, the power pin termination including a socket configured to receive a mating end of a power pin, the power pin termination including a spring band contact received in the socket along the tubular portion, the spring band contact having a plurality of mating interfaces pinching inward for mating with the power pin, a first edge of the power socket body being rolled inward to form a retaining lip to retain the spring band contact in the socket; and a cable termination at the second end, the cable termination defined by a non-tubular deformed portion of the power socket body configured to be terminated to an end of a cable conductor of a cable to electrically connect the power socket to the cable, the deformed portion being a crimp portion configured to interface with the cable conductor at an inner surface of the crimp portion.

19. The power socket of claim 18, wherein the deformed portion of the cable termination includes a socket pinch, the socket pinch reducing at least one dimension of the power socket body compared to the socket to form a stop for the spring band contact.

20. The power socket of claim 18, wherein the power socket body includes a cable stop tab extending into the power socket body defining a cable stop for the cable and wherein the power socket body includes a spring band contact stop tab extending into the power socket body defining a stop surface for the spring band contact, the spring band contact is captured between the spring band contact stop tab and the retaining lip to hold an axial position of the spring band contact in the socket.

* * * * *